United States Patent [19]

Kendziorski

[11] 4,407,505

[45] Oct. 4, 1983

[54] PORTABLE, COLLAPSIBLE PRACTICE GOLF FLAGSTAFF WITH STOWABLE GROUND SPIKE

[76] Inventor: Edward Kendziorski, 1008 Hukill St., Brilliant, Ohio 43913

[21] Appl. No.: 353,919

[22] Filed: Mar. 2, 1982

[51] Int. Cl.[3] ..... A63B 69/36

[52] U.S. Cl. ..... 273/177 R; 273/29 BB; 273/34 R; 273/181 R; 116/173

[58] Field of Search ..... 116/173, 174, 175; 273/34 R, 177 R, 177 A, 177 B, 181 A, 35 R, 29 BB, 411, 181 R

[56] References Cited

U.S. PATENT DOCUMENTS

| | | | |
|---|---|---|---|
| 1,482,036 | 1/1924 | Schablow | 116/173 |
| 2,072,753 | 3/1937 | Vigliotti | 116/173 |
| 2,271,609 | 2/1942 | Hall | 116/173 |
| 2,533,459 | 12/1950 | Holliday | 116/173 |
| 3,011,810 | 12/1961 | Crowder | 116/173 X |
| 3,225,734 | 12/1965 | Bule | 116/173 |
| 3,421,473 | 1/1969 | Weichenrieder | 116/173 X |
| 3,467,388 | 9/1969 | Weiler | 273/176 A |
| 3,602,516 | 8/1971 | Doherty | 273/177 R |
| 3,732,845 | 5/1973 | Istre | 273/34 A X |
| 4,171,134 | 10/1979 | Reck | 273/181 R |

FOREIGN PATENT DOCUMENTS

| | | | |
|---|---|---|---|
| 504628 | 4/1939 | United Kingdom | 273/177 R |

*Primary Examiner*—George J. Marlo

*Attorney, Agent, or Firm*—Sandler & Greenblum

[57] ABSTRACT

A portable, collapsible flagstaff suitable for use to support a practice golf flag is disclosed, wherein the flagstaff comprises at least an upper, middle and bottom segment which are detachably connected to one another; a weighted cylindrical base at the foot of the bottom segment; a spike projecting from the bottom of the base for anchoring the flagstaff in the ground; and a cylindrical cavity in the base in which the spike can be stowed when the flagstaff is in the storage configuration. Also disclosed is a storage configuration wherein the middle and upper segments of the flagstaff are mounted on a bottom keeper plate resting upon the top of the base, and all of the segments are secured together at their upper termini by a top keeper plate or by a 3- or 4-tube top keeper element, and the spike is stowed in an inverted position within the cavity in the base. An elongated "D"-shaped flat-mounting bracket is shown whereby a flag can be pivotably mounted upon the upper segment of the erect flagstaff.

55 Claims, 23 Drawing Figures

PORTABLE, COLLAPSIBLE PRACTICE GOLF FLAGSTAFF WITH STOWABLE GROUND SPIKE

This invention relates to a novel, easily portable, segmented flagstaff which is adapted to be held firmly erect in the ground by a spike, yet to be capable of being broken down into segments and assembled in a unique storage configuration for either storage or carriage, in which the spike is safely stowed within the base of the flagstaff.

It is an object of this invention to provide a portable flagstaff and flag for practice use in the game of golf, especially to serve as a target for driving or "shagging" golf balls. When the flagstaff is broken down and assembled in the storage configuration, it fits conveniently in a standard golf bag along with a normal complement of golf clubs. The portability of the flagstaff enables the golfer to multiply his enjoyment and enhance his skills and the accuracy of his scores by permitting him to move the flag from location to location so as to vary the contours of the practice terrain and provide a variety of obstacles such as sand traps and water hazards, and also to create such features as "doglegs" and similar diversions which would readily be apparent to any golfer.

BRIEF DESCRIPTION OF THE INVENTION

Reference to the following detailed description, read in conjunction with the accompanying drawings, will permit a clearer understanding of the present invention. The reference characters in the drawings refer to like features in each of the views depicted, in which.

DETAILED DESCRIPTION OF THE PRESENT INVENTION

Figure 1:
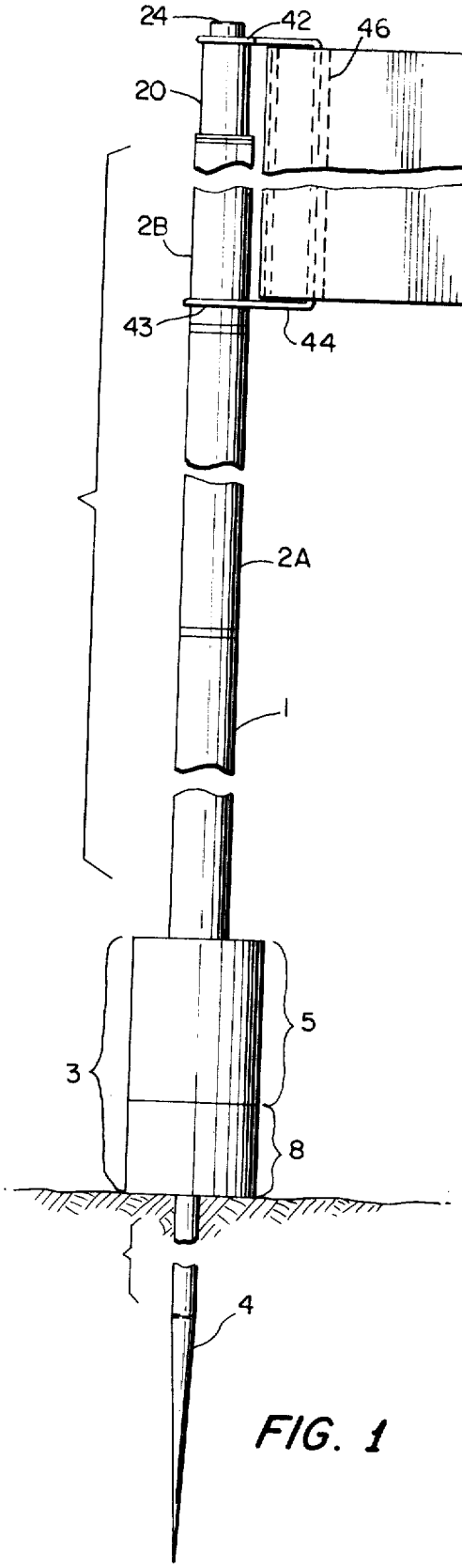
FIG. 1 is a front view of a three-segment flagstaff with the spike embedded in the ground, and a flag mounted at top of the flagstaff by a flag-mounting bracket.
Figure 2:
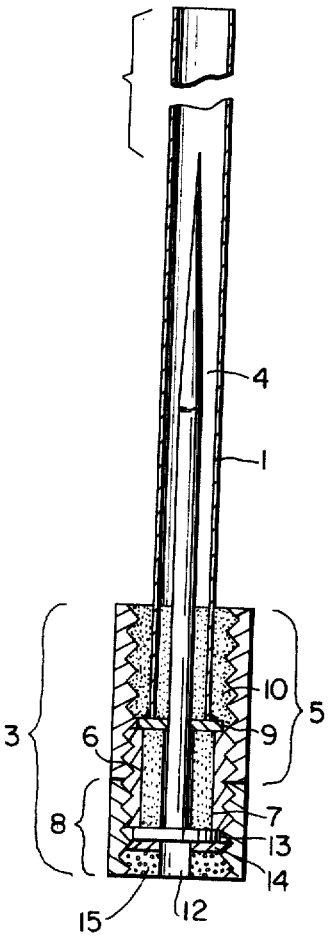
FIG. 2 is a detailed longitudinal section of the base of the flagstaff, with the spike stowed in the interior for storage.
Figure 3:
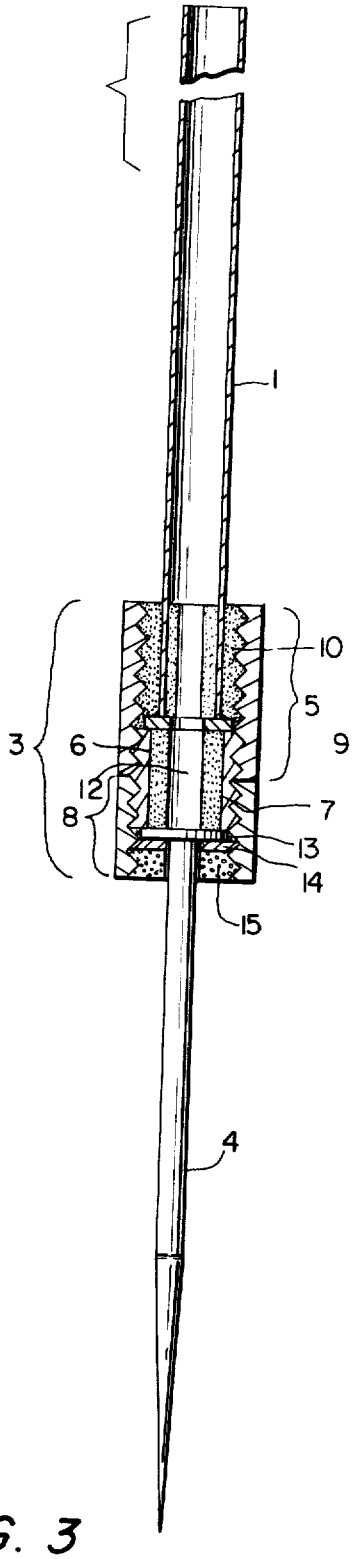
FIG. 3 is a detailed longitudinal section of the base of the flagstaff, identical to FIG. 2 except that the spike extends downwardly from the base for insertion into the ground.
Figure 4:
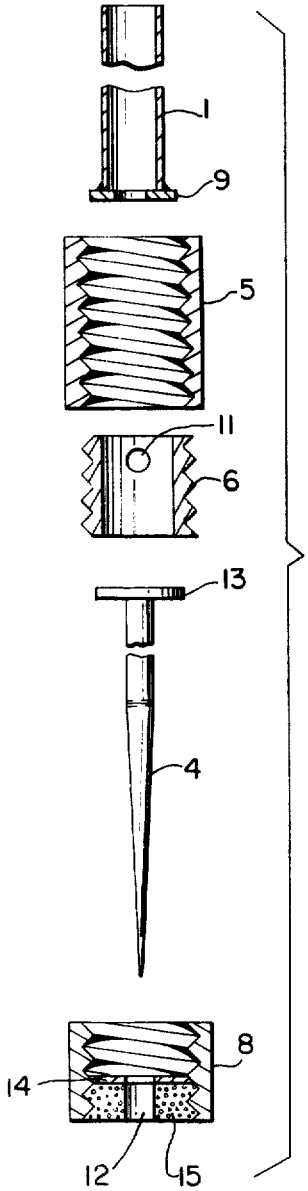
FIG. 4 is an exploded longitudinal section of the components of the base of the flagstaff.

Referring first to FIG. 1, a three-segment flagstaff is depicted comprising bottom segment 1 and middle and upper segments 2A and 2B respectively, weighted base 3, and spike 4, which is shown embedded in the ground. Base 3 comprises a lead-filled shell 5, the bottom portion of which is closed by end cap 8. Also shown in FIG. 1 are, coupled to the top of upper segment 2B, female half coupler 20 capped by stub 24, which is threaded into half coupler 20, and flag 45, which is attached to upper segment 2B by flag mounting bracket 44. Stitching 46 in flag 45 forms a hollow sleeve into which mounting bracket 44 is slipped so as to attach the flag to the bracket. FIGS. 2 and 3 reveal in detail the structure of base 3. The separate components of the base, positioned for assembly, are depicted in FIG. 4. An interior-threaded metal coupling, which may be fashioned from aluminum, stainless steel, or other non-rusting metals which retain their structural integrity at the temperature of molten lead, forms the outer shell 5 of base 3. In the preferred embodiment, the metal of choice for shell 5 is aluminum. Threaded into one end of shell 5 is a tubular, metal, exterior-threaded nipple 6, which is partially screwed into shell 5 to approximately the middle of said nipple, so that a threaded stub 7 (See FIGS. 2 & 3) of nipple 6 projects from shell 5 to provide a male connector upon which end cap 8 can be screwed. Nipple 6 may be aluminum or stainless steel or another high-temperature-resistant, non-rusting metal, but stainless steel is preferred.

Bottom flagstaff segment 1 is terminted by annular flange 9, the outer diameter of which is slightly smaller than the minimum inner diameter of shell 5 (i.e., the diameter as measured from the crests of opposing threads within the shell), so as to allow some tolerance for the movement of the flange within the threaded interior of the shell, but greater than the inner diameter of nipple 6. (See FIG. 4). The flanged end of segment 1 is inserted into the end of shell 5 opposite from the end into which nipple 6 is threaded, until flange 9 comes to rest against the leading surface of nipple 6 within shell 5. Flange 9 has two small holes (not shown) bored in it at diametrically opposite positions, which form a passage from the bottom surface of the flange into the interior of bottom segment 1. Shell 5, nipple 6 and threaded stub 7, together with the portion of bottom segment 1 within shell 5, are filled with molten lead 10 to add weight to base 3 and to embed the bottom, flanged portion of bottom segment 1 therein so as to securely hold and stabilize segment 1 within the base. In the preferred embodiment, along its circumference, near one end, nipple 6 has four small holes 11 bored equidistant from one another, 90° apart. (See FIG. 4, depicting one hole 11 in a sectional front view of nipple 6). In threading the nipple into shell 5, the end of the nipple at which holes 11 are bored is inserted into the shell. FIG. 4 shows nipple 6 positioned for threading into shell 5, and one of holes 11 at the end of the nipple to be inserted. The purpose of holes 11 in nipple 6 and the holes in flange 9 is to permit molten lead to seep therethrough so as to bond nipple 6 and flange 9 securely within shell 5. Moreover, the lead which seeps through the holes in flange 9 rises within the bottom segment 1 until it attains the level of the lead filling shell 5. A cylindrical hole 12 is bored through the center of lead-filled stub 7, nipple 6, and bottom segment 1 to create a passage from the bottom of the stub, through the lead filling of the nipple and the portion of bottom segment 1 within shell 5, to the hollow interior of bottom segment 1 above shell 5.

FIG. 2 demonstrates that when the flagstaff is in the storage configuration, spike 4 is stowed within the base assembly for safety. Spike 4 is an elongated, tapered mandrel, preferably comprised of stainless steel or chromium plated carbon steel, coming to a sharp point for the purpose of anchoring the fully assembled, erect flagstaff to the ground. (FIG. 4 presentes an uncluttered view of spike 4.) At the unpointed end of the spike is an annular flange 13, fashioned from the same metal as the spike and having approximately the same outer diameter as flange 9. Apart from flange 13, the maximum diameter of spike 4 is slightly less than the diameter of hole 12, so that the spike can easily pass through hole 12 until flange 13 is reached at the end of the spike. In the storage configuration, the point of spike 4 may be inserted into hole 12 of threaded stub 7 (FIGS. 2 & 3), and the spike allowed to drop through stub 7, nipple 6, and the lead-filled portion of bottom segment 1, and finally into the hollow interior of bottom segment 1, until it is stopped by the leading surface of flange 13 meeting the bottom surface of stub 7. To secure the spike in this position, and to assure that the spike does not slide out of the base assembly, a threaded metal end cap 8 (See FIG. 4) is screwed tightly onto stub 7, thus holding flange 13 against the bottom surface of the stub. As an alternative to the foregoing procedure, spike 4 can be stowed within base 3 by the steps of inserting the flanged end of the spike into the open end of cap 8 so that the rear surface of flange 13 comes into flush contact with the interior rear surface of cap 8, i.e., disk 14 (FIG. 4); inserting the point of spike 4 into the orifice of hole 12 in the lead filling of threaded stub 7; sliding the spike through hole 12 until the leading edge of end cap 8 comes into contact with threaded stub 7; and screwing cap 8 upon stub 7.

Cap 8 is fabricated from an interior-threaded, hollow metal cylinder having threaded a short distance into one end thereof a thin metal disk 14. (FIG. 4) Disk 14 is threaded into the cylinder to the point that the distance from its leading surface within the cylinder to the opening of the cylinder at the end farthest therefrom is approximately equal to the sum of length of threaded stub 7 protruding from the bottom of shell 5 and the thickness of flange 13. All the space within the cylinder behind disk 14, up to the rear rim of the cylinder, is filled with a hardened, waterproof, metal-powder-filled mastic material 15, the exposed back surface of which forms a smooth, hard, circular plane which is parallel to the plane of disk 14 within the cylinder and normal to the walls of the cylinder. At the center of such circular plane, hole 12 is extended by boring a hole through the mastic 15 and disk 14, thus forming an open channel from one end of the cylinder to the other. The hole thus formed is referred to hereafter as hole 12. In this form, the cylinder is depicted in FIG. 4 as end cap 8. In the preferred embodiment, the metal cylinder and disk 14 are comprised of aluminum, and the mastic material 15 is a cross-linked epoxy resin-steel powder compound. However, the metal cylinder and disk 14 should be made of the same metal of which shell 5 is fabricated, if such metal is not aluminum. The purpose of the epoxy-steel compound is to prevent moisture from corroding the base of the cap when spike 4 is extended and embedded in the ground.

FIG. 3 depicts the base assembly when spike 4 is extended for use. In this case, the rear surface of flange 13 is placed upon the bottom surface of stub 7 so that the spike projects away from stub 7, and hole 12 in the rear interior of end cap 8 is passed over the pointed end of the spike and the cap is screwed down tightly onto the stub. Alternatively, the pointed end of the spike can be passed through hole 12 in end cap 8 at the inner, rear surface thereof, until the leading surface of flange 13 comes into flush contact with disk 14, and cap 8 is then threaded tightly onto stub 7, to fasten the spike to the stub, thereby permitting the use of the spike to anchor the assembled flagstaff to the ground.

FIG. 4 depicts bottom segment 1 and nipple 6 positioned to be inserted into opposite ends of shell 5. Spike 4 is shown in the extended position, disposed to be fastened to the bottom of nipple 6 (i.e., stub 7 [FIGS. 2 and 3]), by end cap 8.

The Storage Configuration

Figure 5:
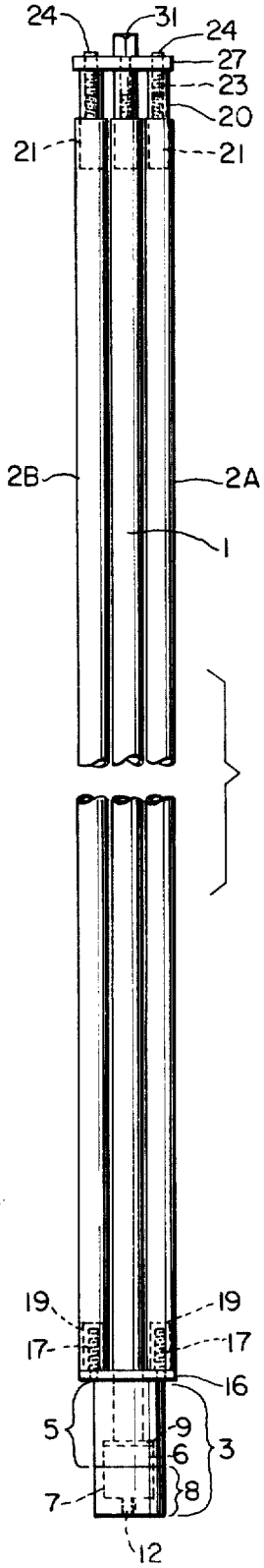
FIG. 5 is a front view of a three-segment flagstaff assembled in the storage configuration.
Figure 8A:
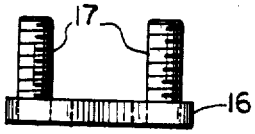
FIGS. 8A and 8B are a side and top view, respectively, of a bottom, oval keeper plate for use with a three-segment flagstaff.
Figure 8B:
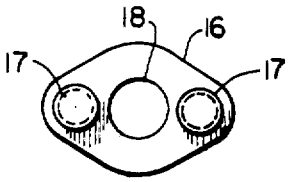
Figure 8C:
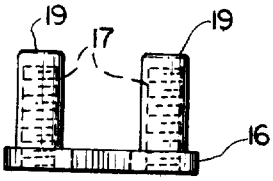
FIG. 8C is a side view of the bottom, oval keeper plate shown in FIG. 8A adapted for slip coupling.
Figure 10:
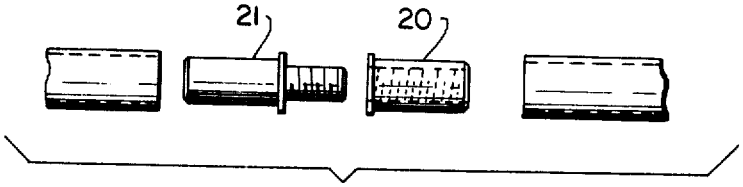
FIG. 10 is a side view of threaded male and female half couplers and a fractional side view of the segments to be joined thereby.
Figure 11:
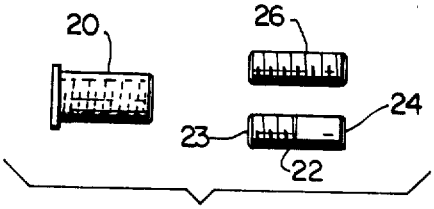
FIG. 11 is a side view of an internally threaded female half coupler and two types of threaded studs which are employed to adapt the segments of the flagstaff to receive the top keeper plate.

FIG. 5 depicts a three-segment flagstaff, broken down into segments and mounted on base 3 in the storage configuration. Elements 5, 6, 7, 8, 9 and 12 are the elements comprising the base as shown in FIGS. 2 and 3, except that spike 4 and lead filling 10 are not shown. In the storage configuration depicted in FIG. 5, the spike would be stowed inside the base, as shown in FIG. 2. FIG. 5 presents a side view of bottom, oval keeper plate 16 and stud bolts 17, as adapted for slip coupling by caps 19, (See FIG. 8C), which provides a means for mounting middle and upper segments 2A and 2B upon the base. Bottom keeper plate 16 is a metal, preferably aluminum, oval plate of approximately one-quarter inch thickness. Details of bottom keeper plate 16 are shown in FIGS. 8A, 8B & 8C. Threaded stud bolts 17 project upwardly from the oval bottom keeper plate on either side of center hole 18 along the horizontal axis of the oval (FIG. 8B). These bolts, which may be modified by threading thereon adaptor caps 19 to provide them with smooth surfaces (FIG. 8C) if slip coupling with middle and upper segments 2A and 2B is desired, are used to secure middle and upper segments 2A and 2B to the base. As an alternative to the use of adaptor caps 19, studs 17 may be adapted for slip coupling by threading female half couplers 20 (FIG. 10) thereon, or studs 17 may be fashioned with smooth, instead of threaded, surfaces, so that slip coupling may be accomplished without the need for modifying the surface of the studs. Furthermore, if it is desired to affix segments 2A and 2B to the base by screw coupling, this may be achieved by using the threaded stud bolts 17 as depicted in FIG. 8A.

Figure 6:
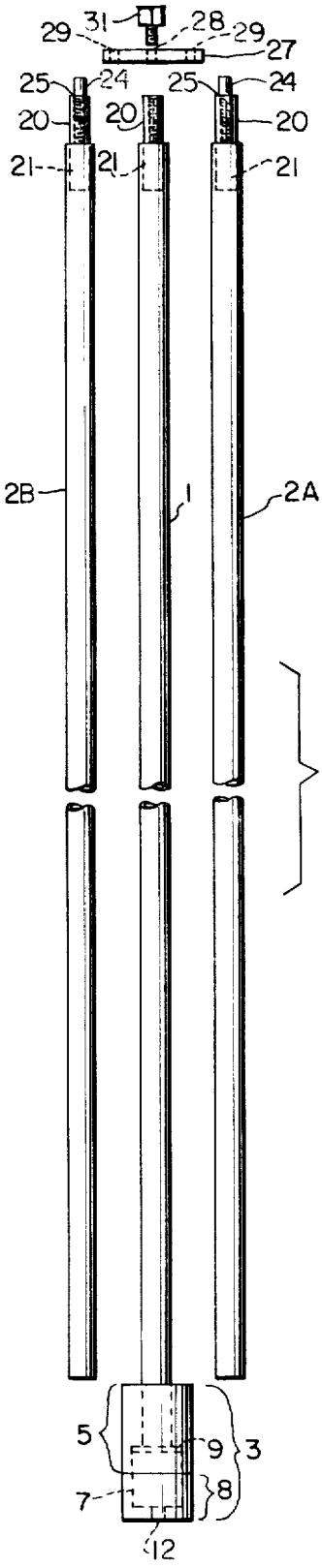
FIG. 6 is an exploded front view of the segments of a three-segment flagstaff in the storage configuration.

As shown in FIGS. 5 & 6, segments 2A and 2B, and that portion of bottom segment 1 extending above bottom keeper plate 16, are of equal length. If screw coupling with threaded stud bolts 17 is desired, the smooth interior surfaces at one end of segments 2A and 2B are modified by slipping therein interior threaded female half couplers 20 (FIG. 10) so as to provide both segments with interior threading to permit threading them upon the stud bolts. If slip coupling is desired, no change is necessary for segments 2A and 2B, since their interior surfaces are inherently smooth, but threaded stud bolts 17 must be modified by adaptor caps 19 or half couplers 20 to permit the segments to be slipped thereon.

The opposite ends of segments 2A and 2B are terminated by threaded male half couplers 21 (FIG. 10), the smooth-surfaced portions of which are slipped into the open ends of the segments so that the reduced, exterior-threaded male protuberances of couplers 21 protrude therefrom. As will subsequently be made clear, there will normally be no need to remove these male half couplers from the segments. Therefore, it is recommended that they be permanently affixed to the tops of the segments—e.g., by means of adhesives such as epoxy cements, or by spot welding them to the segments. Interior-threaded female half couplers 20, which are tubular, smooth-exterior cylinders threaded along the entire length of their interior surface, are then screwed down on the protruding male protuberances of couplers 21, the length of which protuberances is less than that of the threading within coupler 20, so that segments 2A and 2B are terminated by the interior-threaded female openings of couplers 20. Like middle and upper segments 2A and 2B, bottom segment 1, which forms the center segment in the storage configuration for the three-segment flagstaff shown in FIGS. 5 & 6, is also terminated at the top by a threaded male half coupler 21, which is preferably permanently affixed to the segment, upon which is threaded female half coupler 20.

Figure 7A:
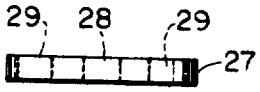
FIGS. 7A and 7B are a side and top view, respectively, of a three-holed top keeper plate for use with a three-segment flagstaff.
Figure 7B:
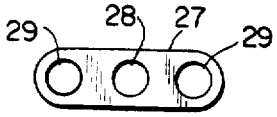

At this point, however, the upper termini of the three-segments may vary, depending on the means to be employed to secure the segments together at the top. In the embodiment depicted in FIGS. 5 & 6, where the tops of the three segments are secured by top keeper plate 27 (FIGS. 7A & 7B), the threaded female openings of half couplers 20 atop segments 2A and 2B are modified by screwing therein the threaded portions of partially threaded cylindrical studs 22 (See FIG. 11). The threaded end of stud 22, which comprises approximately one-half the length thereof, is designated by the numeral 23, while the remaining, smooth-surfaced, unthreaded portion at the opposite end is designated as stub 24. (FIGS. 1, 5, 6 & 11). The outer diameter of half coupler 20 is greater than that of stud 22, so that when stud 22 is screwed into coupler 20, the top surface of the walls of coupler 20 forms an annular ledge or shoulder 25 (FIG. 6), above which projects the unthreaded stub 24 of stud 22.

With respect to bottom segment 1, FIGS. 5 & 6 reveal an embodiment in which the female half of coupler 20 at the upper terminus of this segment is left unmodified. Thus, when holes 29 in the top keeper plate 27 are slipped over stubs 24 atop segments 2A and 2B, the keeper plate will rest upon ledges 25 at the point where stubs 24 emerge from couplers 20, and upon the top of coupler 20 atop bottom segment 1, and center hole 27 in the top keeper plate will lie directly over the threaded female opening of female coupler 20 atop segment 1. (See FIG. 7B for a top view of top keeper plate 27, which plainly depicts holes 28 and 29, and FIG. 6, which depicts a side view of top keeper plate 27 showing holes 28 and 29 disposed respectively above coupler 20 atop bottom segment 1 and above studs 24 atop segments 2A and 2B.) It should be noted that the diameters of holes 28 and 29 are less than the outer diameter of half couplers 20, so that when top keeper plate 27 is slipped over stubs 24, it does not also pass over couplers 20, but instead comes to rest on the top surfaces of the walls of the couplers, as just described. To fasten the top keeper plate to the segments, hand-turnable bolt 31 (FIG. 13) is inserted through center hole 28 and screwed into female coupler 20 at the top of segment 1. (See FIGS. 5 & 6).

In an alternative embodiment for securing top keeper plate 27 to the tops of segments 1, 2A and 2B in the three-segment storage configuration, the female half couplers 20 atom segments 2A and 2B are modified in the same manner as in the preceding embodiment by threading therein the threaded portion of stud 22 so that smooth-surfaced stub 24 projects from the tops of said couplers. The female half coupler 20 atop segment 1, however, instead of being left unmodified as in the preceding embodiment, so as to allow for fastening the top keeper plate thereto by means of a bolt, is adapted by the threading therein of cylindrical stud 26 which is threaded along its entire length (See FIG. 11).

Stud 26 is threaded only partially into coupler 20 until it comes into contact with the leading surface of the threaded protuberance of male coupler 21 which has been threaded into female coupler 20 at the opposite end from stud 26. In this way, a sufficient length of stud 26 remains protruding above coupler 20 to allow ample thread for nut 30 (FIG. 12) to be threaded onto the stud after it has passed through center hole 28 in top keeper plate 27, and the keeper plate has been rested atop the three segments. As with segments 2A and 2B, the insertion of stud 26 into coupler 20 atop segment 1 results in the formation of an annular ledge or shoulder 25 at the point where stud 26 emerges from the coupler, and it is upon these ledges that keeper plate 27 is laid after holes 29 and 28 have been passed over stubs 24 and stud 26, respectively.

Top keeper plate 27, which is employed with both of the foregoing embodiments of the three-segment configuration, is a metal, preferably aluminum, plate, approximately one-quarter inch in thickness, in the shape described by the linear translation of a circle. (See FIG. 7B.) Three circular holes of approximately the same diameter are cut in keeper plate 27 in such a manner that the centers thereof are colinear and are situated along the transverse axis thereof. (See FIG. 7B). These holes are spaced along the transverse axis of top keeper plate 27 so that the center of center hole 28 lies at the middle of the transverse axis and is equidistant from the centers of holes 29 which lie on either side of hole 28. Holes 28 and 29 are spaced the same distance apart on top keeper plate 27 as are center hole 18 and stud bolts 17 on bottom keeper plate 16. The diameters of center hole 28 and holes 29 are slightly greater than those of stud 26 and stubs 24, so that stud 26 and stubs 24 can fit therethrough without difficulty. Thus, as previously described, top keeper plate 27 can be mounted upon segments 1, 2A and 2B by placing holes 29 and 28 over stubs 24 and stud 26, respectively, and inserting stubs 24 and stud 26 through said holes.

As noted previously, the diameters of holes 28 and 29 are less than the outer diameter of half coupler 20, so that when top keeper plate 27 is slipped over stubs 24 and stud 26 as just described, it comes to rest upon ledges 25 at the point where stubs 24 (FIG. 6) and stud 26 emerge from couplers 20. Keeper plate 27 is secured in this position by threading hand-turnable nut 30 (FIG. 12) onto the portion of stud 26 projecting through center hole 28 above the keeper plate. Instead of the "hex" nut depicted in FIG. 12, any other hand-turnable nut, such as a wing nut, may also be employed.

Figure 9:
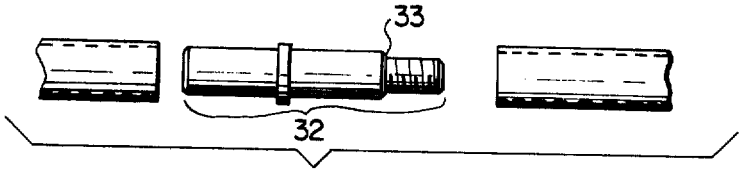
FIG. 9 is a side view of a double coupler which may be employed to adapt the segments of the flagstaff to receive the top keeper plate.

In the foregoing embodiment, and in any other embodiment of the storage configuration in which it is desired that one or more of the segments be terminated at the top by a threaded stub, (e.g., in the just-described embodiment—stud 26), so as to permit fastening the top keeper plate to the segments by means of a hand-turnable nut, it is possible to avoid the need to combine male half coupler 21, female half coupler 20, and stud 26, by employing instead optional double coupler 32, which is illustrated at FIG. 9. Double coupler 32 is a unitary element, the shape and dimensions of which are identical to the just-described combination in which female half coupler 20 is threaded on the male protuberance of male coupler 21, and stud 26 is screwed into coupler 20 at the opposite side. Thus, in practical application, double coupler 32 is identical to and equivalent in function to the three-component combination with the exception that it cannot be disassembled into component parts. In the present invention, this distinction has theoretical significance in only one instance: When it is desired to change the method of attaching the top keeper plate to the segments in the storage configuration by switching from the first embodiment discussed above—where the top keeper plate is fastened to segment 1 by means of bolt 31—to the attachment method used in the second-discussed embodiment—where the keeper plate is fastened by threading nut 30 upon threaded stud 26. In this case, stud 26 can simply be threaded into coupler 20 atop segment 1 to convert the first embodiment into the second. Plainly, if it is desired to switch from the second embodiment to the first, stud 26 is simply removed from coupler 20 atop segment 1.

Notwithstanding this single circumstance in which double coupler 32 is technically not interchangeable with the three-component combination, as a matter of practicality, the distinction is insignificant. If a golfer wished to have the versatility of being able to use either a bolt or a nut to fasten the top keeper plate to the top of segment 1 in the storage configuration, he would be required to carry both hand-turnable bolt 31 and hand-turnable nut 30. Furthermore, when he converted from nut to bolt fastening, he would have to remove stud 26 from the female half coupler 20 atop segment 1, and carry that component as well. Surely, the practical golfer would prefer not to carry any more components than necessary. Moreover, there is no particular advantage to the ability to alternate between the two means of fastening the top keeper plate. Thus, it can be said with some confidence that in any embodiment of this invention which, in its storage configuration calls for the top keeper plate to be secured to the top of the segments by a nut and threaded bolt arrangement, it is preferred that the bolt be an integral part of a double coupler 32 which is joined to the top or tops of a single or multiple segments, as the case may be. Accordingly, whenever it is desired to fasten the top keeper plate by a bolt, it is preferable to employ double coupler 32 in lieu of the combination of male half coupler 21, female half coupler 20 and cylindrical threaded stud 26. As with male half coupler 21, it is preferred that the smooth-surfaced end of double coupler 32 should be permanently joined to the segments in which it is inserted.

Figure 12:
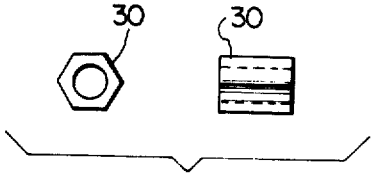
FIG. 12 is a top and side view of the hexagonal, hand-turnable nut employed to fasten the top keeper plate to the segments of the flagstaff in the storage configuration.

It should be obvious to one of ordinary skill in the mechanical arts that the methods described in the foregoing embodiments for securing the segments to the top keeper plate are only a few of a great many permutations of possible methods. To demonstrate their multiplicity, it is helpful to consider the potential combinations of attachment means for affixing the top keeper plate to the tops of the segments in the three-segment storage configuration. To begin with, either one, two or all three segments can be fastened to the top keeper plate at the same time. For example, if all three segments are terminated by double coupler 32, three threaded male projections will rise above the top keeper plate, upon which nuts can be threaded. It is not necessary that any of these must be "hex" nuts as depicted at FIG. 12. Any other hand-turnable nuts, such as wing nuts, would suffice. In addition, if fewer than all three of the segments have a male terminus, and the remaining segments have internally threaded female termini to accept threaded bolts, numerous combinations are evident. Plainly, in the case of a four-segment flagstaff, the possible combinations are even more numerous. The only invariable requirement of either a three- or four-segment flagstaff is that, in order to ensure the structural integrity of the assembly in storage configuration, it is essential that the segment which is embedded in base 5 of the flagstaff (i.e., segment 1 in the three-segment embodiment, segment 37 in the four-segment embodiment) must be fastened to the top keeper plate by whatever attachment device—i.e., nut or bolt—is compatible with the terminus of the segment. Any and all of the just-described fastening arrangements are contemplated by the inventor and are within the scope of this invention.

In still another embodiment of the invention, the flagstaff is comprised of four segments instead of three. In terms of operative principles, the novel aspects of the three-segment flagstaff described above are also applicable to the four-segment embodiment. Thus, the base assembly depicted in FIGS. 2 and 3 is essentially identical to that employed with the four-segment flagstaff, except that the bottom keeper plate is circular instead of oval, and bears three stud bolts instead of two. (See FIG. 16 for a fragmented view of a four-segment flagstaff in the storage configuration, and an interior view of the base assembly, not including the spike. FIG. 17 shows a top view of circular bottom keeper plate 34.) As can be seen from FIG. 17, the three stud bolts 35, which project from the bottom keeper plate 34, are adapted for slip coupling by adaptor caps 19, and are evenly disposed around center hole 36 in the keeper plate approximately 120° from each other.

Figure 16:
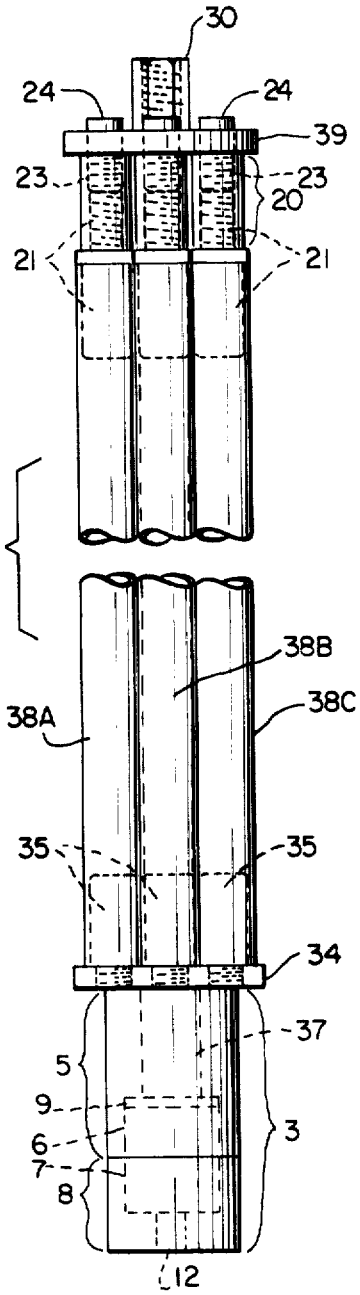
FIG. 16 is a fragmentary front view of a four-segment flagstaff in the storage configuration.
Figure 17:
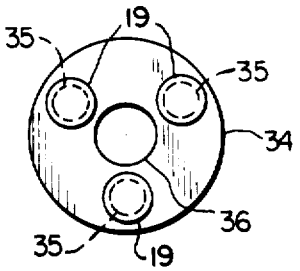
FIG. 17 is a top view of a bottom keeper plate employed in the storage configuration of a four-segment flagstaff.

FIG. 16 contains an interior view of bottom segment 37 embedded in base 3. The remaining three segments 38A, 38B, and 38C are shown mounted on stud bolts 35, rising above the base. Bottom segment 37, which in the storage configuration is passed through center hole 36 in the bottom keeper plate, is concealed behind segment 38B in the view shown in FIG. 16. As shown in FIG. 16, the smooth-interior female openings at the top of segments 38A, 38B, and 38C are modified by slipping therein, and preferably permanently joining thereto, male half couplers 21, upon the reduced, exterior-threaded protuberances of which are threaded interior-threaded female half couplers 20. Into the threaded female openings at the opposite ends of half couplers 20 are screwed the threaded portions 23 of partially threaded studs 22 so that unthreaded stubs 24 protrude from the tops of couplers 20. (Details of coupler 20 and stud 22 are revealed in FIG. 11). Although not shown in FIG. 16 because concealed by segment 38B, bottom segment 37 is terminated at the top by double coupler 32, which also is preferably permanently joined to the segment. (See FIG. 9). Thus, the reduced, threaded male protuberance of double coupler 32, which is also concealed by segment 38B, rises above bottom segment 37 to the same height that stubs 24 protrude above the couplers 20 atop segments 38A, 38B, and 38C. Also not shown in FIG. 16 are annular ledges 25, which are formed at the point at which stubs 24 emerge from couplers 20 atop segments 38A, 38B, and 38C, and annular ledge 33 at the point at which the reduced, threaded protuberance of double coupler 32 joins the greater-diameter, smooth-surfaced cylindrical shaft thereof. (See FIGS. 6 & 9).

Figure 18:
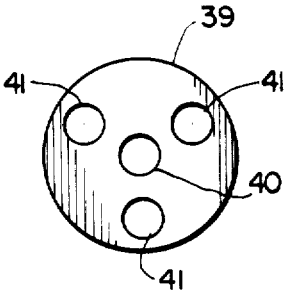
FIG. 18 is a top view of a top keeper plate employed in the storage configuration of a four-segment flagstaff.

In order to stabilize the four segments, top keeper plate 39 is affixed thereon. Keeper plate 39, which is depicted in FIG. 18, comprises a circular metal plate, preferably aluminum, having a thickness of approximately one-quarter inch, in which are cut a center circular hole 40, and three satellite, circular holes 41 which are evenly disposed around the center hole 40 approximately 120° from each other. The diameters of holes 40 and 41, which are approximately the same, are greater than those of stubs 24 and the reduced, threaded protuberance of double coupler 32, but less than the outer diameter of annular ledges 25 and 33. Thus, when top keeper plate 39 is placed upon the tops of the four segments, with holes 40 and 41 aligned over the threaded protuberance of double coupler 32 and stubs 24 respectively, these parts will pass through said holes, and keeper plate 39 will come to rest upon ledges 25 and 33. At this point, the keeper plate is secured atop the four segments by tightly threading a hand-turnable nut such as nut 30 onto the portion of the threaded protuberance of double coupler 32 projecting through hole 40 above the top keeper plate, until the bottom surface of the nut comes into flush contact with the top surface of the keeper plate.

An alternative means for securing the top keeper plate, already described with respect to the three-segment storage configuration, can be achieved by substituting for double coupler 32 atop bottom segment 37, the combination of male half coupler 21 and female half coupler 20, so as to leave bottom segment 37 terminated only by the threaded female opening of coupler 20. Then, when holes 41 in top keeper plate 39 are slipped over stubs 24 atop segments 38A, 38B, and 38C, center hole 40 will be directly above the opening of coupler 20 atop bottom segment 37 so that the keeper plate can be fastened to the bottom segment by inserting threaded, hand-turnable bolt 31 through hole 40 and screwing it tightly into coupler 20. As discussed previously with respect to the three-segment storage configuration, there are a large number of possible combinations by which the top keeper plate can be secured to the segments. Without being limited by the incompleteness of this listing, these can include any combination of nut- or bolt-fastening techniques on from one to all four of segments 37 and 38A, 38B and 38C, provided that bottom segment 37 must be fastened to the top keeper plate in every case.

Figure 19:
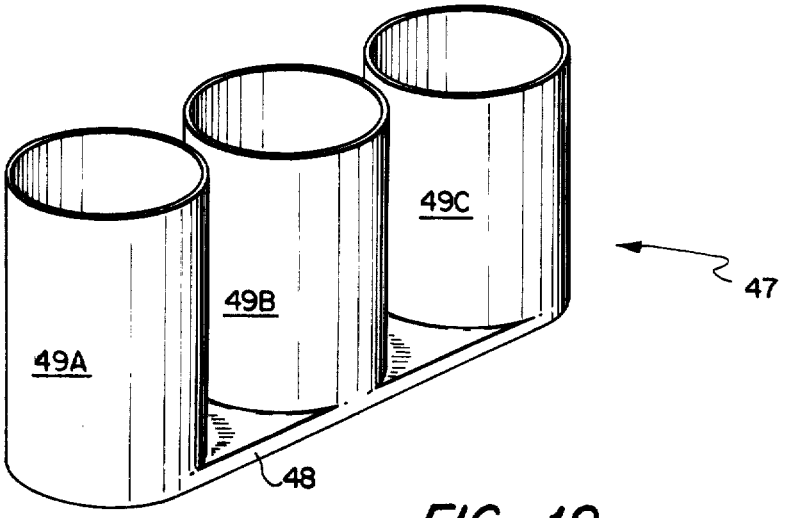
FIG. 19 is a perspective view of a three-tube top keeper element employed in the storage configuration of a three-segment flagstaff.
Figure 20:
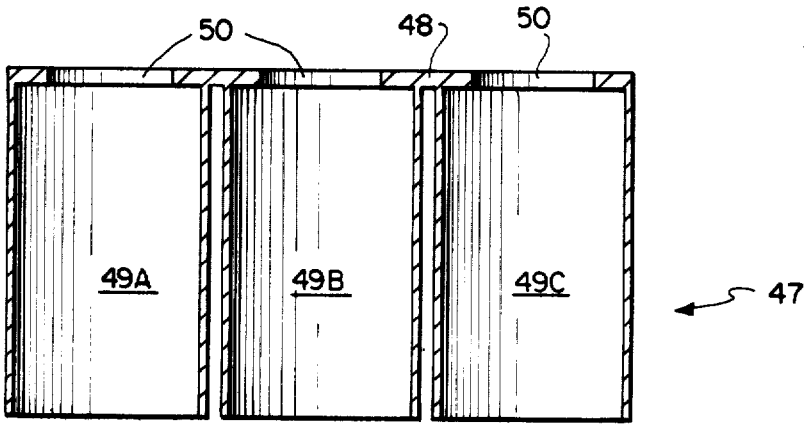
FIG. 20 is a sectional view of the three-tube top keeper element depicted in FIG. 19.

In addition to all of the means described above for securing the upper terminus of the flagstaff segments together, there is yet another approach which accomplishes that result without the need for the type of top keeper plate previously described. In the case of the three-segment flagstaff, the means for bringing this about is the three-tube top keeper element 47 depicted in FIGS. 19 & 20. Top keeper element 47 is a metal, preferably stainless steel, implement comprising an elongated base plate 48 of approximately 1/16 inch thickness in the shape described by the linear translation of a circle, upon one side of which three identical, cylindrical hollow tubes 49A, 49B, and 49C are bonded in a close side-by-side relationship so that they project perpendicularly above and away from the base plate. Three colinear circular holes 50 are cut into base plate 48 along its transverse axis, and are spaced the same distance apart as are holes 28 and 29 in top keeper plate 27. Cylindrical tubes 49A, 49B and 49C are disposed along base plate 48 so that the centers of holes 50 coincide with centers of the three tubes. Thus, holes 50 form passages through the base plate into the center of the hollow interiors of tubes 49A, 49B, and 49C. The tubes are spaced in precisely the same relationship as are center hole 18 and stud bolts 17 on bottom keeper plate 16, and their inner diameter is slightly greater than the outer diameter of female half couplers 20 atop flagstaff segments 2A and 2B and the equivalent diameter of the smooth shaft of double coupler 32 atop bottom segment 1, thus enabling them to be tightly, but removably, slipped over couplers 20 and 32 atop the three segments.

When three-tube top keeper element 47 is employed to secure the tops of the three segments, the female half couplers 20 atop segments 2A and 2B are adapted by screwing partially-threaded studs 22 therein so as to leave unthreaded stubs 24 protruding therefrom, and the upper terminus of bottom segment 1 is modified by slipping double coupler 32 therein so that the reduced, threaded protuberance thereof projects above the bottom segment. The three hollow tubes of the three-tube top keeper element are then aligned over the female half couplers atop middle and upper segments 2A and 2B, and the smooth-surfaced shaft of double coupler 32 atop bottom segment 1, and slipped thereon. When holes 50 reach the top surface of stubs 24 and the reduced, male protuberance of double coupler 32, they slip thereover so that stubs 24 and said protuberance pass through holes 50 and project above the top surface of base plate 48. At this point, three-tube keeper element 47 is firmly secured to the three segments by threading a hand-turnable nut such as nut 30 tightly down upon the threaded protuberance until it comes into flush contact with the top surface of base plate 48.

It should be obvious that the operative principles of the three-tube top keeper element would be equally applicable to the four-segment flagstaff. Of course, the shape of the three-hole keeper element would have to be adapted to receive four, rather than three-segments. This can be accomplished by employing a circular base plate having a circular hole at the center surrounded by three identical satellite holes, 120° apart, and four identical hollow, cylindrical tubes, each of which is concentric to the hole at the center of the base plate or to one of the satellite holes, and bonded to one side of the base plate in such a manner that the four tubes project perpendicularly above it. Although a view of this four-tube top keeper element is not shown, it can easily be envisioned by reference to FIG. 17, which depicts the bottom keeper plate for the four-segment embodiment of the flagstaff. The four cylindrical tubes of the four-tube keeper element are disposed on the base plate in precisely the same locations as are the three stud bolts 35 and center hole 36 on bottom keeper plate 34, in FIG. 17. The holes in the base plate are cut in the same relative positions as are the holes in top keeper plate 39, shown in FIG. 18. Thus, the tube in the center of the circular base plate will stand directly over and concentric to the hole cut in the center of the base plate, and will be surrounded by three satellite tubes spaced 120° apart around the center tube, each of which is concentrically seated over holes cut in the base plate. As with the three-tube keeper element shown in FIGS. 19 & 20, the inner diameter of the hollow tubes is slightly greater than the outer diameter of female half couplers 20 atop segments 38A, 38B and 38C (FIG. 16) and the equivalent diameter of the smooth-surfaced shaft of double coupler 32, atop bottom segment 37, thus permitting the hollow tubes to be tightly, but removably, slipped over couplers 20 and 32 atop the four segments. The diameter of the four holes in the base plate is less than the inner diameter of the hollow tubes but greater than the diameter of stubs 24 and the maximum outer diameter of the reduced, threaded male protuberance of double coupler 32.

When the four-tube top keeper element is used to secure the tops of the four segments, the female half couplers atop segments 38A, 38B, and 38C are adapted by screwing therein the threaded portions of partially-threaded studs 22 so as to leave smooth, unthreaded stubs 24 protruding therefrom, and double coupler 32 is slipped into the upper terminus of bottom segment 37 so that the reduced, threaded male protuberance of the double coupler projects from the top of the bottom segment. Then, the four hollow tubes are aligned over the couplers atop the four segments, and slipped thereon. When the holes in the base plate reach the top surface of stubs 24 and the threaded protuberance of double coupler 32, they pass thereover so that stubs 24 and said protuberance protrude through the four holes and project above the top surface of the base plate. The four-tube keeper element is then firmly secured to the four segments by threading a hand-turnable nut tightly down upon the protuberance of double coupler 32 which protrudes through the hole in the center of the base plate, until the nut comes into flush contact with the top surface of the base plate.

It should be obvious that the just-described means for securing the three- and four-tube top keeper elements to the tops of the flagstaff segments can be adapted so that the fastening device will be a hand-turnable threaded bolt rather than a nut. To accomplish this, it is necessary to provide an interior-threaded female opening atop the bottom segment. This can be achieved simply by slipping male half coupler 21 into the upper terminus of the bottom segment and threading female half coupler 20 onto the reduced, male portion thereof, so as to leave the upper threaded interior of coupler 20 open and unmodified, in contrast to the female couplers atop the other segments, which are modified by studs 22. Then, when the tube in the middle of base plate 48 is slipped over female coupler 20 atop the bottom segment, the hole in the center of the base plate will lie directly above the threaded female opening of coupler 20, and the keeper element can be secured to the assembly by inserting bolt 31 through the center hole of the base plate and screwing it tightly into coupler 20 atop the bottom segment.

It appears that the use of three- and four-tube top keeper elements in the storage configuration of the flagstaff may result in a more rigid structure than that secured by a top keeper plate as described previously.

The Assembled Flagstaff

FIG. 1 depicts a completely assembled three-segment flagstaff, anchored to the ground by spike 4, and carrying flag 45 mounted on bracket 44 attached to the erect, upper segment. A four-segment flagstaff would vary only by the fact that an additional segment is used and that the four segments are individually shorter than the segments in the three-segment embodiment so that the overall assembled length of both the four- and three-segment flagstaffs would be approximately the same. It is preferred that the overall assembled length, from the top of the erect flagstaff to the bottom surface of the base, be between approximately six and one-half and seven and one-half feet. Flagstaffs having lengths greater or less than the preferred range are nevertheless within the scope of the invention and the claims appended hereto.

The manner in which the segments are fitted together in order to assemble the flagstaff depends on the character of the terminai of the individual segments. The first, unvarying principle is that at least one of the two openings at the ends of each of the segments other than the bottom segment embedded in base 3 must be compatible with the stud bolts projecting from the bottom keeper plate, taking into account that the stud bolts may be adapted if necessary to achieve such compatibility. In the case of the three-segment flagstaff, the stud bolts in question are stud bolts 17, (FIGS. 8A, 8B & 8C), while in the case of the four-segment embodiment, they are stud bolts 35 (FIGS. 16 & 17).

Figure 13:
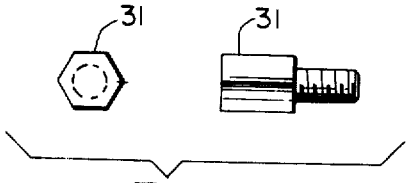
FIG. 13 is a top and side view of a hand-turnable bolt which alternatively can be used to fasten the top keeper plate to the segments of the flagstaff in the storage configuration.

Taking a three-segment flagstaff by way of example: in the preferred embodiment, each of segments 2A and 2B terminates at one end in a smooth-interior female opening compatible for slipping over stud bolts 17 when adapted for slip coupling by caps 19 (FIG. 8C) or female half couplers 20. Inserted into, and preferably permanently affixed to, the opposite ends of these segments are the smooth-surfaced ends of male half couplers 21, upon the reduced, threaded male protuberances of which are threaded interior-threaded female half couplers 20. (See FIG. 10.) Thus, both segments 2A and 2B terminate at one end with smooth female openings and at the opposite end in interior-threaded female half couplers 20 which have been threaded upon male half couplers 21, which in turn have been slipped into one of the open ends of the segments. Thereafter, the female half couplers 20 atop segments 2A and 2B are modified by screwing the threaded portion 23 of studs 22 therein, so that unthreaded stubs 24 project from the tops of the half couplers 20. In cases where the storage configuration will provide for fastening top keeper plate 27 to the top of segment 1 by means of hand-turnable bolt 31, the smooth-interior female opening at the top of segment 1 is modified in the same manner as segments 2A and 2B, by insertion of male half coupler 21 and threading thereon female half coupler 20. Unlike segments 2A and 2B, however, no further modification is made to the terminus of segment 1, so that segment 1 is terminated by the interior-threaded female opening of half coupler 20 in order to permit the top keeper plate to be fastened thereto by bolt 31. (FIG. 13).

In cases where the storage configuration will provide for securing the top keeper plate to the top of segment 1 by means of a hand-turnable nut such as "hex" nut 30, the smooth opening on top of segment 1 is modified by inserting and permanently affixing therein the smooth-surfaced, cylindrical shaft of double coupler 32 (FIG. 9). As so modified, in the storage configuration, center hole 28 of top keeper plate 27 is passed over the reduced, threaded protuberance of double coupler 32 so that a hand-turnable nut can be threaded thereon to fasten the keeper plate to segment 1.

When placing either of the foregoing embodiments of the invention in the storage configuration, the center hole 18 of bottom keeper plate 16 is slipped over the top of bottom segment 1 and allowed to slide down segment 1 until it comes to rest flush upon the upper surface of base 3. Then the smooth-interior female ends of segments 2A and 2B are slipped over stud bolts 17, as adapted by caps 19, on bottom keeper plate 16, so that segments 2A and 2B, as well as bottom segment 1, are disposed in a close, side-by-side co-linear relationship (FIG. 5) and rise perpendicularly above the bottom keeper plate. It should be noted that the coupling means atop segments 1, 2A and 2B are not removed from the segments when the storage configuration is disassembled and the flagstaff is erected. More particularly, the combinations of female half coupler 20, and stud 22, which are joined to the threaded male protuberance of half couplers 21 affixed to the tops of segments 2A and 2B, are not removed from those segments, and double coupler 32, which is permanently affixed to the top of segment 1, remains projecting above it. Thus, in breaking down the erect flagstaff for storage, there is no need to attach these components to the segments, for they are already present.

In the instance where segment 1 is capped by female half coupler 20, top keeper plate 27 is placed so that holes 29 pass over both of stubs 24 projecting from half couplers 20 atop segments 2A and 2B, and laid upon ledges 25 at the base of stubs 24 atop segments 2A and 2B, and on the top surface of coupler 20 atop segment 1. Bolt 31 is then inserted through center hole 28 in the top keeper plate and screwed into half coupler 20 at the top of segment 1, thereby fastening the top keeper plate to segment 1 and securing the assembly in the storage configuration. When the terminus of segment 1 is the reduced, threaded protuberance of double coupler 32, holes 29 in top keeper plate 27 are laid over stubs 24 protruding from couplers 20 atop segments 2A and 2B, and center hole 28 is laid over the threaded protuberance, so that stubs 24 pass through side holes 29 and the threaded protuberance passes through center hole 28, and the keeper plate rests upon ledges 25 and 33. Thereupon, the assembly is secured by threading a hand-turnable nut such as nut 30 upon the portion of the threaded protuberance protruding above the top keeper plate through center hole 28.

Assembly of an erect flagstaff from the storage configuration begins with reversing most of the steps just described so as to dismantle the storage configuration. Accordingly, the first step is to remove the means by which the top keeper plate is fastened to the tops of segments 2A, 2B, and 1 (i.e., by unscrewing bolt 31 or nut 30, as the case may be) and thereafter to lift the top keeper plate from the tops of the three flagstaff segments. At this point, segments 2A and 2B are removed from adapted stud bolts 17 and set aside. As noted previously, the combination of male half couplers 21, female half couplers 20, and studs 22 atop segments 2A and 2B should not be removed, nor is double coupler 32 atop segment 1 disturbed. Next, bottom keeper plate 16 should be removed by sliding it to the top of segment 1 and lifting it therefrom. The flagstaff has now been broken down into its principal components: segments 2A and 2B, and segment 1 (including base 3 to which it is permanently attached) (See FIGS. 2 & 3). In the storage configuration, of course, spike 4 is stowed within the base (FIG. 2), and for safety, it should not be dattached to the base in the extended position (FIG. 3) until the user is prepared to insert the erect flagstaff into the ground. Thus, while erecting the flagstaff, the spike should be left within the base until it is needed.

To erect the flagstaff, the smooth-interior female opening of either segment 2A or 2B is slipped onto whichever of double coupler 32 or female half coupler 20 is atop segment 1, so as to join the two segments together. As a result, the partially erected flagstaff (comprising only two segments), terminates with the combination of male half coupler 21, female half coupler 20 threaded thereon, and stud 22 screwed therein. The smooth-interior female opening of the remaining segment is then slipped over the female half coupler 20 atop the segment that is coupled to segment 1. At this point, the three constituent segments of the three-segment flagstaff have been united and the flagstaff is essentially complete. All the remains is to attach flag 45 to the top portion of the uppermost segment (See FIG. 1) by means of flag-mounting bracket 44 (FIG. 15), and the flagstaff is ready for use. (The flag and mounting bracket are detailed in an upcoming discussion.)

The golfer may wish either to carry the assembled flagstaff to its intended location, or to carry it in the storage configuration and assemble the erect flagstaff on site. In either case, when the erect flagstaff has been fully assembled, the golfer needs only to unscrew cap 8 from stub 7 to remove spike 4 from base 3, and then attach the spike to the base in the extended position by placing the surface of flange 13 in flush contact with the lead-filled bottom of stub 7 and fastening it there by slipping hole 12 in the cap over the point of the spike, sliding the cap down the spike until it reaches stub 7, and rethreading the cap on the stub. Alternatively, the golfer can pass the pointed end of the spike through hole 12 in the interior, rear surface of the end cap until the leading surface of flange 13 comes into flush contact with disk 14 within the cap, and then rethread the cap on stub 7 so as to fasten the spike to the stub. With the spike now extended, the flagstaff is ready to be planted in the ground at the location which the golfer has selected.

The Flag and Flag-Mounting Bracket

Figure 14:
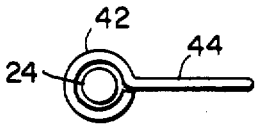
FIG. 14 is a top view of the flag mounting bracket attached to the top portion of the upper segment of the flagstaff by upper collar ring means 42.
Figure 15:
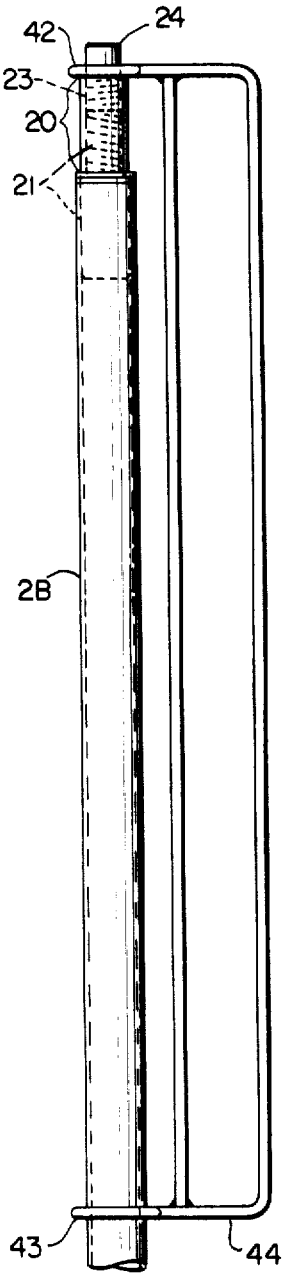
FIG. 15 is a side view of the flag mounting bracket attached to the top portion of the upper segment of the flagstaff, and includes a side view of the lower collar ring means portion of the mounting bracket encircling said upper segment of the flagstaff.

The preferred embodiments of the flag and flag-mounting bracket for use with the present invention are depicted in FIGS. 1, 14, and 15. FIG. 1 shows flag 45 slipped over the D-shaped portion of mounting bracket 44 and mounted upon the top of the upper segment of the erect, three-segment flagstaff. FIG. 14 illustrates the upper collar ring 42, which is a unitary part of mounting bracket 44, mounted atop the upper segment of the erect flagstaff. The inner diameter of the upper collar ring is slightly greater than the outer diameter of stub 24 which protrudes from the female half coupler 20 atop the upper segment of the erect flagstaff (See FIGS. 1 & 15), so that said upper collar ring can easily pass thereover, and less than the outer diameter of coupler 20, from which stub 24 protrudes, so that, after being slipped over stub 24, it comes to rest at ledge 25, which is formed at the point where stub 24 emerges from coupler 20 (See FIG. 6, which depicts ledge 25 in connection with a representation of the flagstaff segments positioned for assembly in the storage configuration.)

FIG. 15 depicts a side view of mounting bracket 44 mounted upon the upper flagstaff segment 2B by upper collar ring 42 and lower collar ring 43, which, like the upper collar ring 42, is also an integral part of the mounting bracket. The inner diameter of the lower collar ring is slightly greater than the outer diameter of upper segment 2B, so that it can easily pass over the upper segment as well as other parts of the erect flagstaff such as coupler 20, whose outer diameter is somewhat less than that of segment 2B. Mounting bracket 44 is a relatively long and narrow "D"-shaped implement which may be comprised of a moderately heavy gauge metal wire, such as one-eighth inch galvanized steel or stainless steel or copper wire. The length of the left-hand vertical side of the "D" portion of the bracket is slightly greater than that of the short side of rectangular flag 45 and the width of the "D" is approximately one inch. Flag 45, as shown in FIG. 1, comprises a doubled over, rectangular piece of cloth or canvas which is hemmed on all four edges. At one of the short sides of the flag, a seam 46 is sewn parallel to that side and a short distance from the hem on that side, so as to form a sleeve having a width approximately the same as but not less than that of the "D" portion of bracket 44. When a flag of a shape different from flag 45 is employed, a similar sleeve should be sewn into the appropriate end of the flag. For example, when the flag is in the shape of an isosceles triangle, the sleeve should be formed at the base thereof.

As is shown in FIG. 15, upper and lower collar rings 42 and 43 extend respectively from the upper and lower horizontal sections of the "D"-shaped portion of bracket 44, perpendicular to and away from the left-hand vertical side of the "D." To mount the flag upon the flagstaff, it must first be attached to the mounting bracket. If the width of the sleeve sewn into the flag is very close to that of the "D" portion of bracket 44, the flag should be made of a fabric having sufficient elasticity to permit inserting the bracket into the sleeve by slipping one of the collar rings into one end of the sleeve and sliding the bracket, collar ring first, through the length of the sleeve until the collar ring emerges from the opposite end of the sleeve. When there are numbers or letters on the flag, care must be taken to assure that the flag is mounted right-side-up upon the flagstaff. To accomplish this, it is necessary to slide the flag onto the mounting bracket either by inserting upper collar ring 42 into the opening of the sleeve at the bottom edge of the flag or by inserting the lower collar ring 43 into the opening of the sleeve at the top edge of the flag, and then sliding the bracket through the sleeve until the collar ring emerges from the opposite end of the sleeve. Once the flag has been attached to mounting bracket 44, the bracket is placed—lower collar ring 43 down—above stub 24 projecting from female half coupler 20 atop the upper segment 2B of the erect flagstaff, and passed over stub 24, coupler 20 and segment 2B, until upper collar ring 42 passes over stub 24 and comes to rest upon ledge 25 atop coupler 20 at the foot of stub 24. (See FIGS. 1 & 15).

While there are undoubtedly a great number of alternative flag-mounting means that are known in the art, the means described above and illustrated in FIGS. 1, 14 & 15, represents the preferred flag-mounting technique for use with the instant invention. Among the reasons for this preference are that the means just described can be employed without the need for any modification of the flagstaff, and it provides a mounting technique which avoids the need for permanent features of the flagstaff such as set screws, clips, and hooks which might interfere with assembly of the flagstaff in the storage configuration. Also, the fact that the flag can easily be removed from the bracket is a significant advantage when it becomes desirable to launder the flag. An additional advantage of the mounting means described herein is that because mounting bracket 41 is supported on the flagstaff principally by upper collar ring 42 resting lightly upon the top surface of female coupler 20 at ledge 25, the flag can easily be rotated around the flagstaff. As a result, in a breeze, the flag points in the direction of the wind, thus giving the golfer invaluable information as to wind direction at the site where he has planted the flagstaff. On very windy days, it is possible that the flag-mounting bracket could be lifted off the top of the flagstaff if the flag were hit by a powerful gust of wind. This difficulty can be overcome by screwing threaded stud 26 in place of partially-threaded stud 22 into half coupler 20 atop the upper segment of the erect flagstaff. After upper collar ring 42 is rested on ledge 25 on half coupler 20, a nut can be loosely threaded onto stud 26 so as to secure the bracket and simultaneously retain pivotability about stud 26.

Although the concept of a pivotable golf flag has been recognized in the prior art, the flag attachment means employed in such cases are ill-suited for use with the present invention. For example, the inventor is aware of flag-mounting means described in U.S. Pat. No. 3,732,845, granted to Istre; U.S. Pat. No. 3,602,516, granted to Doherty; and U.S. Pat. No. 3,011,910 granted to Crowder, each of which discloses a segmented or collapsible flag pole assembly which employs a flag-mounting means that conceivably could be used with the invention herein. Istre, U.S. Pat. No. 3,732,845, shows the use of collar rings to attach a flag-mounting bracket to a flagstaff. These collar rings are pivotably mounted on the flagstaff by a screw-type key member which is loosely fitted into an annular groove around the upper portion of the flagstaff, so that the key member articulates with the keying groove and can be freely rotated around its circumference. Use of this system in the instant invention would deprive the golfer of the convenience provided by the ability to use middle and upper segments 2A and 2B interchangeably in erecting the flagstaff, since the system disclosed in the Istre patent would require the grooved segment to be on top.

The patent to Doherty, U.S. Pat. No. 3,602,516, discloses flag attachment means in the form of right angle hooks which project from the side of the top section of the flag pole. Unlike the attachment means used by Istre, this method for attaching the flag to the flagpole would not allow the flag to pivot in the wind, and the requirement for hooks on the upper section of the pole would preclude the interchangeable use of segments 2A and 2B in erecting the flagstaff in accordance with the present invention. In addition, the hooks on the upper segment could easily interfere with the assembly of the segments in the storage configuration.

The flag-mounting means taught by the Crowder U.S. Pat. No. 3,011,810, calls for the use of a flag which has an open, hemmed sleeve at one end. Instead of using a separate mounting bracket, however, Crowder slips the sleeve of the flag directly over the top of the flagpole and slides the flag over the pole until the sleeve is taut. To prevent the flag from sliding down the pole, a flat, triangular tab, which can be slipped over the edge of that sleeve in order to press the sleeve tightly against the pole, is screwed into the upper portion of the flagpole. This technique for attaching the flag to the flagpole suffers from the same disadvantages as those inherent in the attachment means taught by Doherty.

Applicant is also aware of U.S. Pat. No. 2,072,573 granted to Vigliotti, which discloses a pivotable golf flag mounted on a unitary, unsegmented flagstaff. This patent teaches the use of ball bearings to make a flag mounting bracket pivotable. Thus, the flag mounting bracket is far more complex than that used by applicant and would require significantly greater manufacturing cost and time. Furthermore, the Vigliotti invention requires that the top portion of the flagstaff be modified to accommodate the ball bearings, thus negating the interchangeability of the segments if employed in the instant invention.

Last, applicant is aware of U.S. Pat. No. 1,482,036 granted to Schablow, which discloses a flag mounting system utilizing collar rings to which the flag is attached. Rather than being pivotably mounted on the flagstaff, however, these collar rings are provided with set screws which immovably fix the collar rings to the flagstaff. Since this system for fastening the flag to the flagstaff removes the wind direction-determining function, it is plainly inferior to the means taught in the instant invention.

Accordingly, the flag mounting system taught herein is regarded as superior to each of the mounting means described above, and is the preferred embodiment to be used in the practice of the instant invention.

Uses of the Invention

The novel flagstaff which is the subject of this invention has a number of possible uses beyond as a support for golf flags. Among these is the use of two flagstaffs, without the flag, to support a net in connection with lawn games such as volley ball, badminton, and lawn tennis. A second alternative use is to display directional flags for marking trails in such sports as cross country running or skiing, hiking, bicycling, and the like, or as marking poles for slalom skiing.

In addition, the bottom segment of the flagstaff, attached to the weighted base, can be anchored in a practice green and used for putting practice where the golfer can determine the accuracy of his putting without the need for a cup. To be used most effectively for this purpose, base 3 of the flagstaff should have a diameter of about 1.4 inches. By putting toward the base with a standard golf ball having a diameter of about 1.68 inches, the golfer can assume that if his ball comes into contact with the base, it would have "sunk" in a regulation 4.25 inch cup.

It should be appreciated that the foregoing alternative uses are only a few of the possible uses for which this invention may be employed. In particular, the novel storage assembly of this invention may have use in connection with any of a great number of devices which utilize long poles or handles.

The foregoing description of this invention is considered to illustrate only the principles of the invention, and not to limit it. Furthermore, since numerous modifications and alterations will readily be apparent to those skilled in the art, the instant invention should not be regarded as limited to the exact construction and variations described herein, but should instead be understood to embrace all appropriate modifications or equivalents which may be employed, which fall within the scope of the invention.

What is claimed is as follows:

1. A portable, collapsible flagstaff suitable for use to support a practice golf shag flag or putting flag, comprising a segmented tubular, vertically elongated flagstaff having at least an upper, middle and bottom segment, which segments are detachably connected to one another to form the length of the flagstaff; a weighted cylindrical base at the foot of and concentrically mounted on said bottom segment, permanently attached thereto; and a spike for removably anchoring said flagstaff in the ground; said weighted base being adapted either to store in its interior said spike when the flagstaff structure is disassembled for carriage or storage, or to provide mounting means by which said spike can be attached to the bottom of said weighted base for anchoring said flagstaff to the ground when assembled for use.

2. The structure recited in claim 1 wherein said tubular segments are comprised of a metal taken from the group consisting of stainless steel and aluminum.

3. The structure recited in claim 2 wherein said flagstaff has three detachably connected tubular segments.

4. The structure recited in claim 2 wherein said flagstaff has four detachably connected tubular segments.

5. The structure recited in claim 3 wherein the lengths of the two upper segments are the same and are approximately ¼-inch less than the length of the portion of the bottom segment rising from the weighted base at the foot of said bottom segment.

6. The structure recited in claim 4 wherein the lengths of the three upper segments are the same and are approximately ¼-inch less than the length of the portion of the bottom segment rising from the weighted base at the foot of said bottom segment.

7. The structure recited in claim 2 wherein said tubular segments are attached to one another by means of compatibly threaded female and male termini.

8. The structure recited in claim 2 wherein said tubular segments are attached to one another by means of smooth surfaced male and female termini, the outer diameter of the male terminus being slightly less than the inner diameter of the female terminus so that said male terminus can be tightly but manually-removably inserted into said female terminus.

9. The structure recited in claims 3 or 4 wherein the uppermost tubular segment of said flagstaff bears flag-mounting means thereon.

10. The structure recited in claim 9 wherein said flag-mounting means comprises a narrow, elongated "D"-shaped implement fashioned from a moderately heavy gauge metal wire and wherein horizontal portions of said "D" at the top and bottom thereof extend perpendicularly away from the left-hand vertical side of said "D" and terminate in annular collar rings, the planes of which are perpendicular to the plane of said "D", and the inner diameters of which are such as to permit the collar ring at the end of said extension of the bottom horizontal portion of said "D" to slide over the upper segment of said flagstaff, and to permit the collar ring at the end of said extension of the top horizontal portion of said "D" to rest pivotably on the upper terminus of the upper segment of said flagstaff.

11. The structure recited in claim 10 wherein said moderately heavy gauge metal wire is one-eighth inch in diameter and comprised of a metal taken from the group consisting of galvanized steel, stainless steel, and copper.

12. The structure recited in claim 10 wherein a flag is mounted on said flag-mounting means.

13. The structure recited in claim 11 wherein a flag is mounted on said flag-mounting means.

14. The structure recited in claim 2 wherein said weighted base comprises a lead-filled, interior-threaded cylindrical metal shell having: (1) permanently and immovably embedded therein at one end thereof, to approximately one-half the length of said shell, the bottommost portion of said bottom tubular segment of the flagstaff, said bottommost portion being filled with lead and disposed concentrically in said shell along the longitudinal axis thereof; (2) partially embedded in said shell at the end opposite from said bottom tubular segment, a lead-filled, exterior-threaded cylindrical nipple, which is partially threaded into said shell to the extent of about one-half the length of said nipple, and one end of which protrudes from said shell, said nipple and said bottom tubular segment each being concentric with the other and with said shell; and (3) a small, cylindrical center hole bored through the lead filling of said nipple, said bottommost portion of said bottom tubular segment, and said shell along the longitudinal axes thereof so as to provide a passage through said nipple and said shell and into the hollow interior of said bottom tubular segment above the lead filling of said bottommost portion thereof, said hole being of sufficient diameter to allow said spike to be inserted into and stowed therein.

15. The structure recited in claim 14 wherein said metal shell is comprised of a metal having a higher melting point than lead, and has walls of sufficient thickness to maintain structural rigidity when exposed to molten lead.

16. The structure recited in claim 15 wherein said metal shell is comprised of aluminum.

17. The structure recited in claims 15 or 16 wherein said bottom segment of the flagstaff terminates within said shell in an annular flange.

18. The structure recited in claims 15 or 16 wherein a cylindrical metal end cap having a circular closure at one end and an interior-threaded female opening at the other end is threaded onto the end of said nipple protruding from said shell, the threaded interior walls of said cap being of sufficient length to accommodate the portion of said nipple protruding from the end of said shell and the portion of said spike resting thereon when said spike is positioned for anchoring said flagstaff to the ground, said circular closure having bored through the center thereof a hole of the same diameter as and concentric with said hole bored through the lead filling of said nipple and shell and said bottommost portion of said bottom tubular segment, so that said passage formed by said hole is extended through said circular closure of said cap.

19. The structure recited in claim 18 wherein said metal cylindrical cap is comprised of the same metal as said shell.

20. The structure recited in claim 18 wherein said circular closure of said cap is comprised of a hardened, powdered-metal filled, water-proof mastic material.

21. The structure recited in claim 20 wherein said mastic material comprises a composite of a cross-linked epoxy resin and powdered steel.

22. The structure recited in claim 20 wherein said spike comprises an elongated, tapered metal mandrel terminating in a point at one end and in an annular flange at the opposite end, the maximum diameter of said spike, excepting said annular flange, being slightly less than the diameter of said hole bored into the center of the circular closure of said end cap and the lead filling of said nipple and said shell and said bottommost portion of said bottom tubular segment, so as to permit easy movement of said spike in said hole, and the diameter of said annular flange being greater than that of said hole and approximately the same as the outer diameter of said nipple, and wherein said structure is adapted so that said end cap can alternatively be used to fasten said spike within said shell for storage or to fasten said spike to said weighted base—tapered end pointing downwardly away from said base—so as to allow for insertion of said spike into the ground to support said flagstaff in an upright position.

23. The structure recited in claim 22 wherein said spike is comprised of a metal taken from the group consisting of stainless steel and chromium-plated carbon steel.

24. The structure recited in claim 22 wherein said spike is stored within said shell.

25. The method of assembling the structure recited in claim 24 comprising performing the following steps on the structure recited in claim 22: (1) inserting said spike—pointed end first—into said hole in the lead filling at the end of the portion of the nipple protruding from said shell and moving said spike through said hole until said annular flange at the end of said spike comes into contact with the orifice of said hole in the lead filling at the end of said protruding portion of said nipple, thereby preventing further insertion of said spike; and (2) tightly threading said end cap onto said protruding portion of said nipple so as to securely hold said spike within said shell.

26. The structure recited in claim 22 wherein said spike is fastened to said base—tapered end pointing downwardly away from said base—so as to allow for insertion of said spike into the ground.

27. The method of assembling the structure recited in claim 26 comprising performing the following steps on the structure recited in claim 22: (1) placing said annular flange at the end of said spike flush against the surface of the lead-filling at the end of the portion of said nipple protruding from said shell, so that the tapered end of said spike points downwardly away from said shell; (2) placing the hole in the interior surface of said circular closure of said end cap over the pointed end of said spike with the interior-threaded female opening of said end cap facing said nipple; (3) sliding said end cap over said spike until said end cap comes into contact with said protruding portion of said nipple; and (4) tightly threading said end cap onto said protruding portion of said nipple so as to secure said spike to said base with the pointed end extending downwardly and away from the bottom of said base.

28. The method of assembling the structure recited in claim 26 comprising performing the following steps on the structure recited in claim 22: (1) inserting the pointed end of said spike into the hole in the interior surface of said circular closure of said end cap; (2) sliding said spike through said hole until the leading surface of said annular flange at the end of said spike comes into flush contact with the interior surface of said circular closure; and (3) tightly threading said end cap onto the portion of said nipple protruding from said shell until the bottom surface of said protruding portion of said nipple comes into flush contact with the rear surface of said annular flange within said end cap, so as to secure said spike to said base with the pointed end extending downwardly and away from the bottom of said base.

29. In storage configuration, a portable, collapsible flagstaff having a bottom, middle and upper tubular segment, comprising:

(1) A weighted cylindrical base having an elongated spike removably stored therein;

(2) Said bottom tubular segment permanently attached to said base and rising perpendicularly above it;

(3) Resting upon the top surface of said base, a metal, oval-shaped bottom keeper plate approximately ¼-inch in thickness, having a circular hole at the center thereof of a diameter slightly larger than the outer diameter of said bottom tubular segment, so that said segment can easily pass through said hole, wherein the length of said bottom segment has been passed through said hole so as to permit said bottom keeper plate to rest atop said base;

(4) Two cylindrical stud bolts permanently attached to said bottom keeper plate along the transverse axis thereof, on either side of and equidistant from said circular hole and projecting perpendicularly above said bottom keeper plate so that, when said middle and upper tubular segments are mounted on said stud bolts, said middle and upper segments and said bottom segment rise perpendicularly and upright above said bottom keeper plate in a close, side-by-side relationship;

(5) Mounted upon said stud bolts, said middle and upper tubular segments, which are identical to one another and which have the same outer and inner diameters as said bottom tubular segment and the same length as that portion of said bottom tubular segment which rises above said bottom keeper plate upon said base;

(6) Upon the upper termini of said three tubular segments, means of adapting said termini to receive and be secured to a three-holed top keeper plate;

(7) Resting upon said adapting means upon said upper termini of said three tubular segments, a metal, top keeper plate approximately ¼-inch in thickness, in the shape described by the linear translation of a circle, having spaced along its transverse axis three circular holes of approximately the same diameter, each of which holes is disposed directly over said adapting means atop one of said three segments; and (8) Means fastening said top keeper plate to said adapting means upon said upper terminus of said bottom tubular segment, and securing said three tubular segments in storage configuration.

30. The structure recited in claim 29 wherein said tubular segments are comprised of a metal selected from the group consisting of stainless steel and aluminum.

31. The structure recited in claim 29 wherein said bottom keeper plate and said upper keeper plate are comprised of aluminum.

32. The structure recited in claims 30 or 31 wherein said weighted base is partially filled with lead.

33. The structure recited in claim 29 wherein said means for adapting the upper termini of said three tubular segments comprises: (1) a cylindrical, metal, male coupling element having at one end a smooth exterior surface, the diameter of which is slightly less than the inner diameter of said upper termini of said tubular segments so as to permit said smooth-exterior-surfaced end of said male coupling element to be inserted into said termini, and having at the opposite end a reduced, exterior-threaded cylindrical male protuberance; (2) threaded onto the entire length of said protuberance, a tubular metal female coupling element having essentially the same outer diameter as said smooth-exterior-surfaced end of said cylindrical male coupling element, and a smooth exterior surface, and, along its entire interior surface having threading compatible with that of said protuberance—the length of which female coupling element is sufficiently greater than that of said protuberance as to leave ample threading remaining within said female coupling element after the entire length of said protuberance has been screwed therein; and (3) screwed into said remaining threading of said female coupling elements atop said middle and upper tubular segments, short, cylindrical, partially-threaded metal studs having threading along approximately half their length and a smooth exterior surface along the remaining length, so as to leave (a) smooth-surfaced cylindrical stubs of said partially threaded studs protruding from said interior-threaded female coupling elements atop said middle and upper tubular segments and (b) said-interior threaded female coupling element, unmodified by said cylindrical, partially-threaded stud, atop said bottom tubular segment.

34. The structure recited in claim 33 wherein said means for securing said top keeper plate to said three tubular segments comprises a hand-turnable threaded bolt, the threading of which is compatible with the interior threading of said female coupling element atop said bottom tubular segments, so that said top keeper plate can be fastened to said bottom segment and secured to said three segments by inserting said bolt through the middle hole in said top keeper plate and screwing it into the threaded interior of said female coupling element atop said bottom segment.

35. The structure recited in claim 33 wherein a short, cylindrical stud threaded along its entire length—said threading being compatible with the interior threading of said female coupling element atop said bottom tubular segment—is screwed into the interior of said female coupling element atop said bottom tubular segment so that the leading surface of said stud within said female coupling element is in flush contact with the leading surface of said protuberance of said male coupling element threaded within said female coupling element, and the remainder of said threaded stud projects above the orifice of said female coupling element a sufficient length to permit a nut to be threaded thereon after said threaded stud has been passed through the middle hole in said top keeper plate.

36. The structure recited in claim 35 wherein said means for securing said top keeper plate to said three tubular segments comprises a hand-turnable nut, the threading of which is compatible with the threading of said threading stud projecting above the orifice of said female coupling element atop said bottom tubular segment, so that said top keeper plate can be fastened to said bottom tubular segment and secured to said three segments by threading said nut down upon the portion of said threaded stud projecting through said middle hole in said top keeper plate.

37. The structure recited in claim 35 wherein the upper terminus of the bottom tubular segment, in lieu of the combination of said male coupler, female coupler, and short cylindrical stud threaded along its entire length, is adapted to receive said top keeper plate by a double coupling element having the shape and dimensions of said combination but comprising a unitary element as opposed to a combination of elements, wherein the smooth-surfaced cylindrical shaft of said double coupling element is inserted into and permanently affixed to the upper terminus of said bottom segment.

38. The structure recited in claim 37 wherein said means for securing said top keeper plate to said three tubular segments comprises a hand-turnable nut, the threading of which is compatible with the reduced, exterior-threaded cylindrical protuberance of said double coupling element atop said bottom tubular segment, so that said top keeper plate can be fastened to said bottom tubular segment and secured to said three segments by threading said nut down upon the portion of said threaded cylindrical protuberance projecting through said middle hole in said top keeper plate.

39. In storage configuration, a portable, collapsible flagstaff having a bottom, middle and upper tubular segment, each segment having a smooth interior surface, comprising:

(1) A weighted cylindrical base having an elongated spike removably stored therein;

(2) Said bottom tubular segment permanently attached to said base and rising perpendicularly above it;

(3) Resting upon the top surface of said base, a metal, oval-shaped bottom keeper plate approximately ¼-inch in thickness, having a circular hole at the center thereof of a diameter slightly larger than the outer diameter of said bottom tubular segment, so that said segment can easily pass through said hole, wherein the length of said bottom segment has been passed through said hole so as to permit said bottom keeper plate to rest atop said base;

(4) Two cylindrical stud bolts permanently attached to said bottom keeper plate along the transverse axis thereof, on either side of and equidistant from said circular hole—said stud bolts being situated a sufficient distance from said circular hole to permit said upper and middle tubular segments to be mounted thereon without coming into contact with said bottom segment rising above said keeper plate through said circular hole, and projecting perpendicularly above said bottom keeper plate so that, when said middle and upper tubular segments of said flagstaff are mounted on said stud bolts, said middle and upper segments and said bottom segment rise perpendicularly and upright above said bottom keeper plate in a close, side-by-side relationship;

(5) Mounted upon said stud bolts, said middle and upper tubular segments, which are identical to one another and which have the same outer and inner diameters as said bottom tubular segment and the same length as that portion of said bottom tubular segment which rises above said bottom keeper plate upon said base;

(6) Coupled to the upper terminus of each of said three tubular segments, adapting means comprising (a) a cylindrical, metal, male coupling element having at one end a smooth exterior surface, the diameter of which is slightly less than the inner diameter of said upper termini of said tubular segments so as to permit said smooth-exterior-surfaced end of said cylindrical male coupling element to be inserted into said upper termini, and having at the opposite end a reduced, exterior-threaded, cylindrical male protuberance, wherein said smooth-exterior-surfaced end of said male coupling element is inserted into and permanently affixed to said upper termini of said three tubular segments; (b) threaded onto the entire length of said reduced, threaded male protuberance, a tubular cylindrical, metal female coupling element having the same outer diameter as that of said smooth-exterior-surfaced end of said cylindrical male coupling element, and a smooth exterior surface, and, along its entire interior surface, having threading compatible with that of said protuberance—the length of which female coupling element is sufficiently greater than that of said protuberance as to leave ample female threading remaining within said female coupling element after the entire length of said protuberance has been screwed therein; and (c) screwed into said remaining threading in said female coupling elements atop said middle and upper tubular segments, short, cylindrical, partially threaded metal studs having threading along approximately half their length and a smooth exterior surface along the remaining length, so as to leave (a) smooth-surfaced, cylindrical stubs of said partially threaded studs protruding from said interior-threaded female coupling elements atop said middle and upper tubular segments and (b) said interior-threaded female coupling element, unmodified by said cylindrical, partially-threaded stud, atop said bottom tubular segment;

(7) Slipped over and mounted upon the smooth exterior surfaces of said female coupling elements atop said three tubular segments, a three-tube top keeper element comprising an elongated, approximately 1/16-inch thick metal base plate in the shape described by the linear translation of a circle, upon one side of which three substantially identical, open, cylindrical metal tubes are permanently bonded to said base plate in a close, side-by-side relationship so that said tubes project perpendicularly away from said base plate, the outer diameter of said tubes being approximately the same as that of said tubular segment and their inner diameter being slightly greater than the outer diameter of said female coupling elements atop said three tubular segments so as to allow said tubes to be slipped over said female coupling elements; and three equidiameter circular holes cut into said base plate along its transverse axis, each of said holes being concentric with one of said three open, cylindrical tubes so as to form three cylindrical passages through said base plate into the centers of the hollow interiors of said three cylindrical tubes—the diameter of said holes being slightly greater than the diameter of said smooth-surfaced, cylindrical stubs of said partially threaded stubs protruding from said interior-threaded female coupling elements atop said upper and middle tubular segments so that said stubs can pass easily through said holes—wherein said tubes are spaced along said base plate exactly as said stud bolts and said circular hole at the center of said bottom keeper plate are spaced along said bottom keeper plate, thereby allowing the two tubes of said three-tube keeper element on either side of the tube rising from the middle of said base plate to be slipped over said female coupling elements atop said upper and middle tubular flagstaff segments, and said tube arising from the middle of said base plate to be slipped over said female coupling element atop said bottom tubular segment, until said smooth-surfaced cylindrical stubs protruding from said female coupling elements atop said upper and middle tubular segments pass through said cylindrical passages in said base plate and protrude above said base plate, and said hole in the middle of said base plate rests directly over the threaded female opening in said female coupling element atop said bottom tubular segment; and (8) A hand-turnable, threaded bolt passed through said hole in the middle of said base plate and screwed into said remaining threading in said female coupling element atop said bottom tubular segment.

40. In storage configuration, a portable, collapsible flagstaff having a bottom, middle and upper tubular segment, each segment having a smooth interior surface, comprising:

(1) A weighted cylindrical base having an elongated spike removably stored therein;

(2) Said bottom tubular segment permanently attached to said base and rising perpendicularly above it;

(3) Resting upon the top surface of said base, a metal, oval-shaped bottom keeper plate approximately ¼-inch in thickness, having a circular hole at the center thereof of a diameter slightly larger than the outer diameter of said bottom tubular segment, so that said segment can easily pass through said hole, wherein the length of said bottom segment has been passed through said hole so as to permit said bottom keeper plate to rest atop said base;

(4) Two cylindrical stud bolts permanently attached to said bottom keeper plate along the transverse axis thereof, on either side of and equidistant from said circular hole—said stud bolts being situated a sufficient distance from said circular hole to permit said upper and middle tubular segments to be mounted thereon without coming into contact with said bottom segment rising above said keeper plate through said circular hole, and projecting perpendicularly above said bottom keeper plate so that, when said middle and upper tubular segments of said flagstaff are mounted on said stud bolts, said middle and upper segments and said bottom segment rise perpendicularly and upright above said bottom keeper plate in a close, side-by-side relationship;

(5) Mounted upon said stud bolts, said middle and upper tubular segments, which are identical to one another and which have the same outer and inner diameters as said bottom tubular segment and the same length as that portion of said bottom tubular segment which rises above said bottom keeper plate upon said base;

(6) Coupled to the upper terminus of each of said three tubular segments, adapting means comprising (a) a cylindrical, metal, male coupling element having at one end a smooth exterior surface, the diameter of which is slightly less than the inner diameter of said upper termini of said middle and upper tubular segments so as to permit said smooth-exterior-surfaced end of said cylindrical male coupling element to be inserted into said upper termini, and having at the opposite end a reduced, exterior-threaded, cylindrical male protuberance, wherein said smooth-exterior-surfaced end of said male coupling element is inserted into said upper termini of said three tubular segments;

(b) threaded onto the entire length of said reduced, male protuberance, a smooth-exterior-surfaced, tubular, cylindrical, metal female coupling element having the same outer diameter as that of said smooth-exterior-surfaced end of said cylindrical male coupling element, and, along its entire interior surface having threading compatible with that of said reduced, male protuberance—the length of which female coupling element is sufficiently greater than that of said protuberance as to leave ample female threading remaining within said female coupling element after the entire length of said protuberance has been screwed therein;

(c) screwed into said remaining threading in said female coupling elements atop said middle and upper tubular segments, short, cylindrical, partially threaded metal studs having threading along approximately half their length and a smooth exterior surface along the remaining length, so as to leave smooth-surfaced, cylindrical stubs of said partially threaded studs protruding from said interior-threaded female coupling elements atop said middle and upper tubular segments; and (d) screwed into said remaining threading in said female coupling element atop said bottom tubular segment, a short, cylindrical stud having threading along its entire length—said threaded stud being screwed into said female coupling element until the leading surface of said stud comes into flush contact with the leading surface of said reduced protuberance of said male coupling element within said female coupling element, the remainder of said threaded stud projecting above the orifice of said female coupling element approximately the same distance that said smooth-surfaced stubs of said partially threaded studs project above said female coupling elements atop said middle and upper tubular segments; so as to leave said smooth-surfaced, cylindrical stubs of said partially threaded stubs protruding from said interior-threaded female coupling elements atop said middle and upper tubular segments, and said remainder of said cylindrical threaded stub projecting above said female coupling element atop said bottom tubular segment;

(7) Slipped over and mounted upon the smooth exterior surfaces of said female coupling elements atop said three tubular segments, a three-tube top keeper element comprising an elongated, approximately 1/16-inch thick metal base plate in the shape described by the linear translation of a circle, upon one side of which three substantially identical, open, cylindrical metal tubes are permanently bonded to said base plate in a close, side-by-side relationship so that said tubes project perpendicularly away from said base plate, the outer diameter of said tubes being approximately the same as that of said tubular segments and their inner diameter being slightly greater than the outer diameter of said female coupling elements atop said three tubular segments so as to allow said tubes to be slipped over said female coupling elements; and three equidiameter circular holes cut into said base plate along its transverse axis, each of said holes being concentric with one of said three open, cylindrical tubes so as to form three cylindrical passages through said base plate into the centers of the hollow interiors of said three cylindrical tubes—the diameter of said holes being slightly greater than the diameter of said smooth-surfaced cylindrical stubs of said partially threaded studs atop said middle and upper tubular segments, and the maximum diameter of said threaded stud atop said bottom tubular segment—wherein said tubes are spaced along said base plate exactly as said stud bolts and circular hole at the center of said bottom keeper plate are spaced along said bottom keeper plate; thereby allowing the three tubes of said three-tube keeper element to be slipped over said female coupling element atop said tubular segments until said smooth-surfaced stubs of said partially threaded studs atop said middle and upper tubular segments, and said threaded stud atop said bottom tubular segment, pass through said holes in said base plate and emerge on the other side thereof;

(8) A hand-turnable nut threaded tightly down upon the portion of said threaded stud above said bottom tubular segment projecting through said hole in the middle of said base plate so that said nut is in flush contact with the surface of said base plate.

41. The structure recited in claims 39 or 40 wherein said tubular segments are comprised of a metal selected from the group consisting of stainless steel and aluminum.

42. The structure recited in claim 41 wherein said male coupling elements inserted into the upper termini of said tubular segments are permanently affixed thereto.

43. The structure recited in claims 39 or 40 wherein said bottom keeper plate is comprised of aluminum and said three-tube top keeper element is comprised of stainless steel.

44. The structure recited in claim 43 wherein said male coupling elements inserted into the upper termini of said tubular segments are permanently affixed thereto.

45. The structure recited in claim 39 or 40 wherein said weighted base is partially filled with lead.

46. The structure recited in claim 45 wherein said male coupling elements inserted into the upper termini of said tubular segments are permanently affixed thereto.

47. The structure recited in claim 40 wherein the upper terminus of said bottom tubular segment, in lieu of the combination of said male coupling element, female coupling element, and short cylindrical stud threaded along its entire length, is adapted for coupling with said three-tube top keeper element by a double coupling element having the shape and dimensions of said combination but comprising a unitary element as opposed to a combination of elements, wherein the smooth-surfaced cylindrical shaft of said double coupling element is inserted into and permanently affixed to the upper terminus of said bottom tubular segment, and said hand-turnable nut is threaded tightly down upon the portion of the reduced, threaded, cylindrical male protuberance of said double coupler projecting through said hole in the middle of said base plate so that said nut is in flush contact with the surface of said base plate.

48. The structure recited in claim 47 wherein said male coupling elements inserted into the upper termini of said middle and upper tubular segments and said smooth-surfaced cylindrical shaft of said double coupling element inserted into the upper terminus of said bottom tubular segment, are permanently affixed to said tubular segments.

49. The structure recited in claim 48 wherein said male coupling elements and said smooth-surfaced cylindrical shaft of said double coupling element are permanently bonded to said upper termini of said segments by an epoxy cement.

50. The structure recited in claim 48 wherein said male coupling elements and said smooth-surfaced cylindrical shaft of said double coupling element are spot welded to the upper termini of said segments.

51. The structure recited in claim 39 or 40 wherein said male coupling elements inserted into the upper termini of said tubular segments are permanently affixed thereto.

52. The structure recited in claim 51 wherein said male coupling elements are permanently bonded to said upper termini of said tubular segments by an epoxy cement.

53. The structure recited in claim 51 wherein said male coupling elements are spot welded to said upper termini of said tubular segments.

54. The structure recited in claims 42, 44 or 46 wherein said male coupling elements are permanently affixed to said upper termini of said tubular segments by an epoxy cement.

55. The structure recited in claims 42, 44 or 46 wherein said male coupling elements are spot welded to said upper termini of said tubular segments.

* * * * *